US011172285B1

(12) United States Patent
Li et al.

(10) Patent No.: US 11,172,285 B1
(45) Date of Patent: Nov. 9, 2021

(54) PROCESSING AUDIO TO ACCOUNT FOR ENVIRONMENTAL NOISE

(71) Applicant: Amazon Technologies, Inc., Seattle, WA (US)

(72) Inventors: Ke Li, San Jose, CA (US); Alex Kanaris, San Jose, CA (US); Ludger Solbach, San Jose, CA (US); Carlo Murgia, Santa Clara, CA (US); Kuan-Chieh Yen, Foster City, CA (US); Tarun Pruthi, Fremont, CA (US)

(73) Assignee: Amazon Technologies, Inc., Seattle, WA (US)

( * ) Notice: Subject to any disclaimer, the term of this patent is extended or adjusted under 35 U.S.C. 154(b) by 121 days.

(21) Appl. No.: 16/707,967

(22) Filed: Dec. 9, 2019

Related U.S. Application Data

(60) Provisional application No. 62/904,504, filed on Sep. 23, 2019.

(51) Int. Cl.
*H04R 1/10* (2006.01)
*H04R 1/40* (2006.01)
*H04R 3/00* (2006.01)

(52) U.S. Cl.
CPC ..... *H04R 1/1083* (2013.01); *H04R 1/1016* (2013.01); *H04R 1/1041* (2013.01); *H04R 1/406* (2013.01); *H04R 3/005* (2013.01); *H04R 2420/07* (2013.01)

(58) Field of Classification Search
CPC ..... H04R 1/10
See application file for complete search history.

(56) References Cited

U.S. PATENT DOCUMENTS

| | | | | |
|---|---|---|---|---|
| 2013/0308784 | A1* | 11/2013 | Dickins | G10K 11/002 381/56 |
| 2016/0227336 | A1* | 8/2016 | Sakri | H04R 3/005 |
| 2016/0275966 | A1* | 9/2016 | Jazi | G10L 21/0232 |
| 2017/0251299 | A1* | 8/2017 | Chen | H04R 3/005 |
| 2017/0257697 | A1* | 9/2017 | Sheffield | H04R 1/1041 |
| 2018/0234760 | A1* | 8/2018 | Chen | G10L 21/0208 |
| 2018/0343514 | A1* | 11/2018 | Dusan | G10K 11/17881 |
| 2019/0374386 | A1* | 12/2019 | Halfaker | A61F 11/14 |
| 2020/0382870 | A1* | 12/2020 | Dyrholm | G10L 21/0232 |
| 2020/0396539 | A1* | 12/2020 | Vitt | G01P 5/24 |
| 2021/0065670 | A1* | 3/2021 | Unruh | H04R 3/007 |
| 2021/0074310 | A1* | 3/2021 | Bryan | G10L 21/0216 |

* cited by examiner

*Primary Examiner* — Olisa Anwah
(74) *Attorney, Agent, or Firm* — Lee & Hayes, P.C.

(57) ABSTRACT

This disclosure describes, in part, techniques to process audio signals to lessen the impact that wind and/or other environmental noise has upon the resulting quality of these audio signals. For example, the techniques may determine a level of wind and/or other noise in an environment and may determine how best to process the signals to lessen the impact of the noise, such that one or more users that hear audio based on output of the signals hear higher-quality audio.

18 Claims, 7 Drawing Sheets

PROCESSING AUDIO TO ACCOUNT FOR ENVIRONMENTAL NOISE

RELATED APPLICATIONS

This application claims priority to and is a non-provisional application of U.S. Provisional Patent Application No. 62/904,504, filed on Sep. 23, 2019, the entire contents of which are incorporated herein by reference.

BACKGROUND

As the use of computing devices continues to proliferate, so too does the amount of communication between users over computing devices, such as mobile phones, laptop computers, and the like. In some instances, an example first user may use wireless headphones that include microphone (s) and speaker(s), and that couple with a mobile phone or other device of the first user, to engage in a communication session with a computing device of a second user. For example, a microphone of a wireless earbud may generate an audio signal and may send this audio signal to the mobile phone of the first user, which in turn may send the audio signal over a network to the mobile phone or other device of the second user. Further, the mobile phone or other device of the second user may send an audio signal to the mobile phone of the first user, which may relay the audio signal to the wireless earbud for output on the speaker of the earbud.

Although use of these earbuds may prove convenient for these types of communication sessions, environmental noise, such as wind, may affect the quality of the audio signal generated at an earbud of a user and transmitted to the device of the receiving user. Thus, alleviating the effect of wind and other environmental noises on the quality of the generated audio signal may enhance the experience of the communication session.

BRIEF DESCRIPTION OF THE DRAWINGS

The detailed description is set forth below with reference to the accompanying figures. In the figures, the left-most digit(s) of a reference number identifies the figure in which the reference number first appears. The use of the same reference numbers in different figures indicates similar or identical items. The systems depicted in the accompanying figures are not to scale and components within the figures may be depicted not to scale with each other.

DETAILED DESCRIPTION

Figure 1:
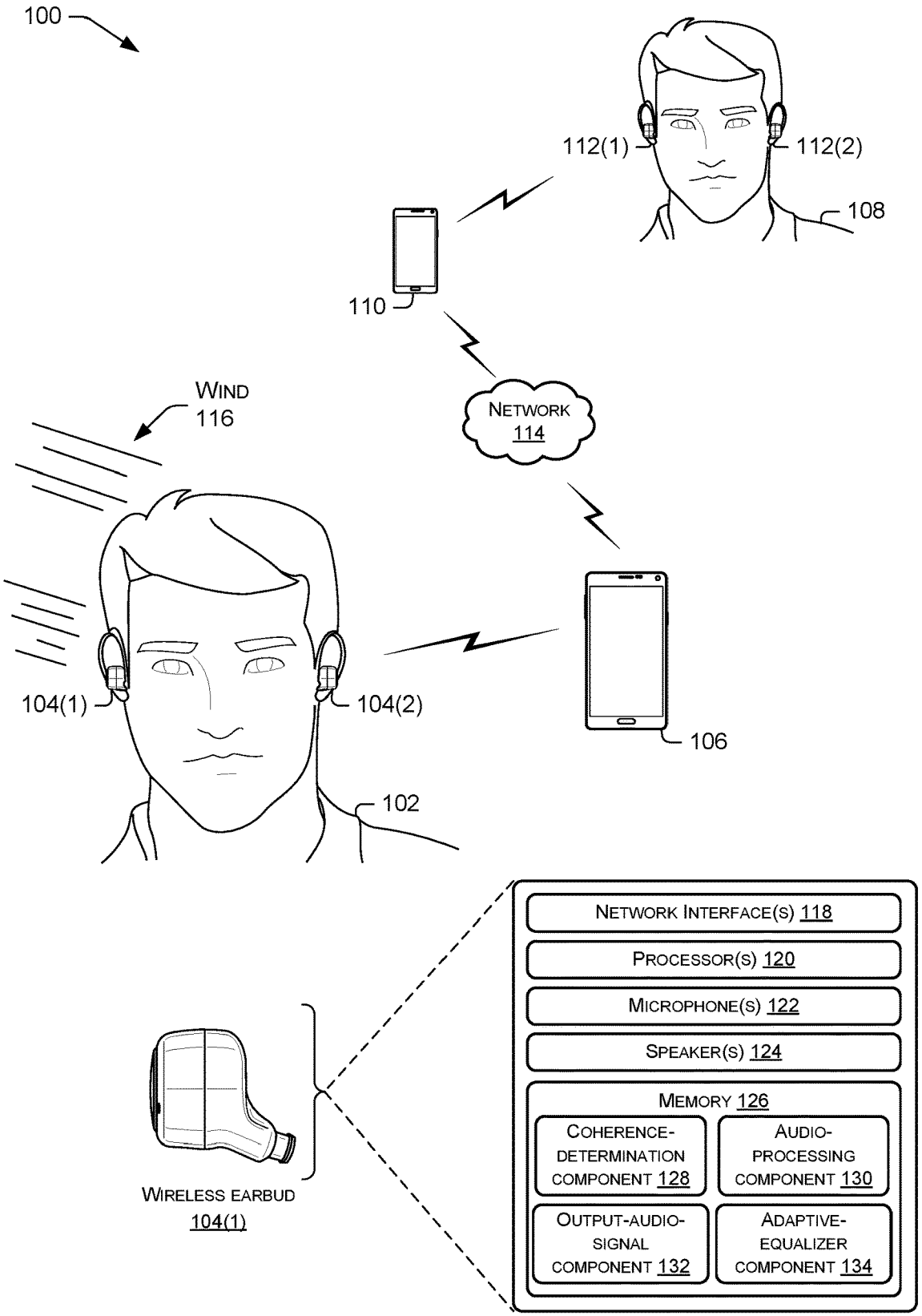
FIG. 1 illustrates a schematic diagram of an illustrative environment in which a user wears wireless earbuds that include speakers and microphones for exchanging voice communications between a mobile device of the user and a mobile device of another user. This figure further illustrates the user may reside in a windy environment and, thus, audio signals generated by the wireless earbuds may be affected by wind noise. As illustrated, however, the wireless earbuds may include functionality for processing the audio signals in a manner that alleviates the effect of the wind and/or other environmental noise.

This disclosure describes, in part, techniques to process audio signals to lessen the impact that wind and/or other environmental noise has upon the resulting quality of these audio signals. For example, the techniques may determine a level of wind and/or other noise in an environment and may determine how best to process the signals to lessen the impact of the noise, such that one or more users that hear audio based on output of the signals hear higher-quality audio.

In one example, one or more headphones (e.g., wired earbuds, wireless earbuds, over-the-ear headphones, etc.) may implement the techniques described herein. For example, these techniques may be implemented by one or more wireless earbuds of a pair of wireless earbuds. In this example, each wireless earbud may include one or more speakers for outputting audio into an ear of a user, as well as one or more microphones for generating audio signals based on captured sound, such as speech of the user. In some instances, each wireless earbud may include at least a first microphone oriented in a first direction and a second microphone oriented in a second direction. In some instances, the first microphone may comprise two "outer" microphones each directed towards the environment of the user and substantially towards a mouth of the user (when residing within an ear of the user). The wireless earbud may also include a third microphone may, in some instances, comprise an "inner" microphone residing within and directed substantially towards an ear canal of the user. Thus, the first and second microphones may be subjected to environmental noise, such as wind, while the third microphone may be substantially protected from this noise. Furthermore, a second wireless earbud, residing in the opposite ear of the user may similarly comprise two outer microphones and at least one inner microphone.

To begin, the techniques may attempt to determine a level of wind or other environment noise present near the user so as to alleviate the impact of this noise upon resulting audio signals. In one example, each of the two outer microphones and the inner microphone of the wireless earbud may generate a respective audio signal (corresponding to a same time period), some of which may be used to determine a level of wind or other environmental noise. For example, the first outer microphone may generate a first audio signal, the second outer microphone may generate a second audio signal, and the third (inner) microphone may generate a third audio signal.

In some instances, the earbud may compare the first audio signal generated by first outer microphone with the second audio signal generated by the second outer microphone. In some instances, the wireless earbud may perform this comparison between the first audio signal and the second audio signal for a determining a presence of wind or other undesired environmental noise. In addition, the second wireless earbud of the pair of earbuds may also generate two outer-microphone signals and may compare these signals to one another for the purpose of detecting wind or other unwanted environment noise. Of course, while this discussion describes the earbuds as each performing this process, in other instances this process may be performed in whole or in part by one more remote server devices and/or the like. Further, while the discussion below describes calculating coherence values by comparing a first audio signal generated by a first outer microphone with a second audio signal generated by a second outer microphone, in other instances the coherence values may be calculated via a comparison between an audio signal generated by an outer microphone and an audio signal generated by an inner microphone. Further, the coherence values may be calculated via a comparison between a first audio signal generated by a first wireless earbud of a pair of wireless earbuds and a second audio signal generated by a second wireless earbud of the pair of wireless earbuds in other instances.

In some instances, each wireless earbud may determine a coherence, or similarity, between the first audio signal generated by the first outer microphone of the respective earbud and the second audio signal generated by the first outer microphone of the respective earbud, with this coherence representing an amount of wind or other unwanted environmental noise occurring within the environment of the user. For example, given that wind within the environment of a user may affect audio signals generated by microphones residing at different locations differently, a lack of coherence between the first and second audio signals may be indicative of wind occurring within the environment, while a relatively high level of coherence may be indicative of little wind within the environment. In some instances, the wireless earbud may determine respective levels of coherence on a per-frequency-range basis such that the techniques used to mitigate any issues created from this wind may be implemented on a per-frequency range basis.

To provide an example, after generating the first outer-microphone audio signal, the wireless earbud may first perform a Fourier Transform (e.g., a Short-time Fourier Transform (STFT), a Fast Fourier Transform (FFT), etc.) on a window of the first audio signal to convert the first audio signal into the frequency domain, resulting in a set of N frequency bins. Further, the wireless earbud may perform a Fourier Transform on a corresponding window the second audio signal to convert the second audio signal into the frequency domain, resulting in a set of N frequency bins for third audio signal. It is to be appreciated that the number, N, of bins may comprise any number, such as 32, 64, 128, 256, or the like. Further, the overall frequency range represented by these bins may comprise any range, such as zero (0) to 8,000 kHz or any other range, and the bins may be of equal size. For instance, in the example of 128 bins from zero (0) to 8,000 kHz, a first bin may represent a frequency range of zero (0) to 62.5 kHz, a second bin may represent a range of 62.5 kHz to 125 kHz, and so forth. As used herein, a first "frequency bin" or a first "frequency range" may be deemed less than a second frequency bin/range based on the beginning frequency of the first bin/range being less than the beginning frequency of the second bin/range and/or based on the end frequency of the first bin/range being less than the end frequency of the second bin/range. For example, a first frequency range of 0 kHz to 62.5 kHz may be deemed less than a second frequency range from 62.5 kHz to 125 kHz, and so forth.

In some instances, after the wireless earbud converts the first and second audio signals into the frequency domain, the wireless earbud may determine a coherence (that is, a level of similarity) between each frequency range of the first audio signal and each corresponding frequency range of the second audio signal. For example, the first wireless earbud may calculate a first coherence value between the first frequency range of the first audio signal and the first frequency range of the second audio signal, a second coherence value between the second frequency range of the first audio signal and the second frequency range of the second audio signal, and so forth.

In some instances, the wireless earbud may calculate these coherence values using the following equation:

$$C_{xy}(f) = \frac{[G_{xy}(f)]^2 + \alpha}{G_{xx}(f)G_{yy}(f) + \alpha} \tag{1}$$

where $G_{xy}(f)$ represents a cross-spectral density between the first audio signal ("x") and the second audio signal ("y"), $G_{xx}(f)$ represents auto-spectral density of the first audio signal, $G_{yy}(f)$ represents auto-spectral density of the second audio signal, and a represents a regularization coefficient, which may be calculated for each frequency bin a priori.

As the reader will appreciate, inclusion of the regularization coefficient in equation (1) may result in an individual coherence value, $C_{xy}(f)$, comprise a number between zero (0) and one (1), where zero (0) represents very little coherence between the audio signals, and hence a significant presence of wind, and one (1) represents perfect coherence and, thus, a complete lack of wind.

After calculating an initial coherence value for one or more frequency ranges (or "bins"), the wireless earbud may proceed to perform one or more smoothing operations on one or more of these values. For example, the wireless earbud may smooth each calculated initial coherence value based on one or more prior coherence values for the respective frequency range. In some instances, this smoothing over time may lessen the amount of change between coherence values for a frequency range over two contiguous time periods to avoid large changes in these values over short amounts of time. Furthermore, in some instances, the effect of prior coherence value(s) on a current, initial coherence value may be larger when moving from a lower value to a higher value (i.e., from more wind to less wind) than when moving from a higher value to a lower value (i.e., from less wind to more wind). In other instances, the opposite may be true, and in still other instances the effect may be equal.

In addition, or in the alternative, the wireless earbud may smooth an initial coherence value across one or more frequency bins. In some instances, the wireless earbud may perform this smoothing operation asymmetrically, such that a coherence value of a particular frequency bin may be modified based on coherence value(s) of one or more prior frequency ranges. For example, a frequency bin corresponding to a range of 125 kHz to 187.5 kHz may be smoothed based on a coherence value of one or more prior frequency bins, such as a bin corresponding to a range of 62.5 kHz to 125 kHz and/or a bin corresponding to 0 to 62.5 kHz.

In some instances, the smoothing of these initial coherence values may result in a set of coherence values that the wireless earbud may use to determine to process audio signals to alleviate the impact of wind and/or other unwanted environmental noise from the signals. In addition to performing one or more of these smoothing functions to the initial coherence values, the wireless earbud may calculate a coherence values for a first set of the frequency bins to determine coherence values for a remainder of the frequency bins. For example, given that wind is often present at relatively lower frequencies, the wireless earbud may calculate coherence values for a set of one or more lower frequency ranges for determining coherence values for relatively higher frequency ranges.

To provide an example, the wireless earbud may calculate coherence values for the first sixteen (16) frequency ranges (e.g., 0 to 62.5 kHz, 62.5 kHz to 125 kHz, etc.). After calculating these values, the wireless earbud may determine whether these coherence values meet one or more predefined criteria. If so, then the wireless earbud may determine that wind is not present in the signal and, thus, may set coherence values for the remaining frequency ranges (e.g., the remaining 112 bins) to a value of one (1) or similar. That is, given that the wireless earbud has determined that the coherence values of the first sixteen (16) frequency bins is not indicative of a meaningful presence of wind, the wireless earbud may determine that wind is not present and, thus, may refrain from altering the audio signals based on coherence values at relatively higher frequencies. In some instances, the criteria for making this determination may be based on an average coherence value of the first set of frequency ranges, a median coherence value, whether a threshold number of the first set of coherence values is greater than a threshold value, and/or the like. For example, in some instances the wireless earbud may calculate an average of the coherence values of the first set of frequency ranges (e.g., the first sixteen bins) and may compare this value to a threshold (e.g., 0.7) to determine whether the average is greater than the threshold. If the average is greater than a threshold, then the wireless earbud may set the remaining coherence values to a value of one (1) or similar. If the average is not greater than the threshold, then the wireless earbud may continue to perform one or more of the smoothing operations on the initial coherence values for the remaining frequency ranges for determining final coherence values for these ranges.

After determining the final coherence values for the number of N frequency ranges, the wireless earbud may process one or more audio signals based at least in part on these values to lessen the impact of wind and/or other unwanted environmental noise from the resulting signals. For example, the wireless earbud may determine whether to use an audio signal generated by one of the outer microphones, an audio signal generated by the inner microphone, or a combination thereof. Stated otherwise, the wireless earbud may determine an amount of an outer audio signal to use and/or an amount of an inner audio signal to use when generating an output audio signal(s) for sending to a remote device, such as a client device operated by another user. Further, while the above process is described with reference to a single earbud, it is to be appreciated that the other wireless earbud of the pair of earbuds may perform the same or similar process based on the first, second, and third audio signals generated by a first outer microphone of the other wireless earbud, a second outer microphone of the other wireless earbud, and the inner microphone of the other wireless earbud.

In some examples, each wireless earbud determines how to generate these output audio signals using one or more different algorithms. For example, the wireless earbud may determine how to generate a first portion of an output audio signal that is less than a predefined frequency using a first algorithm, and may determine how to generate a second portion of the output audio signal that is greater than the predefined frequency using a second, different algorithm. For example, the wireless earbud may generate a portion of an output audio signal that is less than four (4) kHz by using an algorithm that determines, based on coherence values corresponding to frequency ranges that are less than four kHz, whether to generate an output audio signal using an entirety of the corresponding portion of the inner audio signal, an entirety of the outer audio signal, or a mixture thereof. Further, for the portion of the output audio signal that is greater than four kHz, the wireless earbud may use an algorithm that determines an amount of the outer audio signal to use (if any), while not using any of the inner audio signal.

For example, for frequency bins that are less than four kHz, the wireless earbud may determine, for each frequency bin, when the respective coherence value for that frequency bin is less than a first threshold (e.g., 0.3). If so, meaning that the two outer audio signals generated by the wireless earbud have a relatively low coherence to one another, then the wireless earbud may effectively detect the presence of wind and, thus, may generate, for that frequency range, a portion of an output audio signal based on the audio signal generated by the inner microphone. That is, because the coherence value for that respective frequency range indicates a strong presence of wind, the wireless earbud may be configured to select the audio signal generated by the inner microphone, which is protected from wind, rather than the audio signal generated by the outer microphone, which is not protected from the wind.

If, however, the wireless earbud determines that the coherence value for the particular frequency range is not less than the first threshold, then the wireless earbud may determine whether the coherence value is greater than a second threshold value (e.g., 0.7) that is greater than the first threshold value. That is, the first wireless earbud may determine whether there is little presence of window in the current frequency range, as evidenced by the relatively strong coherence between the two audio signals generated by the respective microphones for the current frequency range. If the wireless earbud determines that the coherence value is greater than the second threshold value, then the wireless earbud may generate the portion of the output audio signal corresponding to the current frequency range using the audio signal generated by one of the outer microphones (given that while these outer microphones are generally exposed to wind, wind did not appear to have an impact at this frequency range).

If, however, the coherence value for the current frequency range is not greater than the second threshold value, but is greater than the first threshold value, then the wireless earbud may generate a portion of the output audio signal corresponding to the current frequency range based on both the inner audio signal and the outer audio signal(s). For example, the wireless earbud may determine, based on the coherence value, a weight to apply to each of these different audio signals for determining the resulting portion of the output audio signal. In one example, the first wireless earbud utilizes a linear function from the first threshold (e.g., 0.3) to the second threshold (e.g., 0.7), such that for a frequency range having a value very near the first threshold (e.g. 0.31), the wireless earbud generates a portion of an audio signal for the frequency range that is largely based on the inner audio signal. Conversely, when a frequency range has a coherence value very near the second threshold (e.g., 0.69), then the wireless earbud generates a portion of the audio signal for the frequency range is largely based on the outer audio signal(s). Of course, it is to be appreciated that any other function (e.g., step function, decay function, etc.) may be used to determine how to mix the outer and inner audio signals. Furthermore, it is to be appreciated that the wireless earbud may use the algorithm discussed immediately above to generate a portion of each output audio signal on a frequency bin-by-bin basis based on each corresponding coherence value.

In addition, for frequency ranges that are over four kHz, the wireless earbud may utilize an algorithm that determines how much of an outer audio signal to use (if any at all). For example, for each frequency range between four kHz and eight kHz, the wireless earbud may determine whether the respective coherence value is less than a third threshold value (e.g., 0.7). If so (meaning wind is present), then the wireless earbud may simply refrain from using any data within that particular portion of the audio signal to be output. If not, then the wireless earbud may determine whether the coherence value is greater than a fourth, greater threshold (e.g., 0.9). If so (meaning that very little or no wind is present), then the first wireless earbud may generate the portion of the output audio signal corresponding to the current frequency range using the corresponding portion of the outer audio signal (and none of the inner audio signal). If, however, the coherence value is greater than the third threshold but less than the fourth threshold, then the wireless earbud may generate the corresponding portion of the output audio signal based on an attenuation of a corresponding portion of one or more of the outer audio signals. In some examples, the wireless earbud may apply an amount of an attenuation based on a linear function, a step function, a decay function, or the like. In each instance, the amount of the attenuation may be greater when the coherence value is nearer the first threshold (e.g., 0.69) and lesser when the coherence value is nearer the second threshold (e.g., 0.89). Thus, the wireless earbud may utilize an algorithm for frequency ranges over 4 kHz (or any other example threshold frequency value) where either no audio signal is used (if there is significant wind), an entirety of a corresponding portion of an outer audio signal is used (if there is little or no wind), or an attenuated version of the corresponding portion of the outer audio signal is used (if there is some wind).

Upon generating the different portions of an output audio signal (e.g., 256 portions) for the wireless earbud, the wireless earbud may generate an output audio signal based on the respective generated portions. It is to be appreciated that by generating the output audio signal(s) in this manner, the wireless earbuds may lessen the impact of any wind or other unwanted environmental noise on the quality of audio that is output using the generated output audio signals. That is, by alleviating the impact of wind or other unwanted environmental noise on the resulting output audio signals, the quality of resulting audio may be higher than would result from outputting audio signals that have not been processed based on the presence of wind or unwanted noise.

Thus, the techniques described herein may increase the quality of output audio from audio signals generated at wireless earbuds or the like by alleviating the impact of wind or other unwanted environmental noise on these signals. In some instances, the techniques described herein may be implemented in whole or in part by one or more voice-enabled hearable devices, each of which may include a microphone positioned in the hearable device such that, when worn by a user, faces an ear canal of an ear of the user to capture sound emitted from the ear canal of the user. Further, the voice-enabled hearable device may include one or more other microphones positioned in the hearable device such that, when worn by the user, captures sound from an environment of the user that is exterior the ear of the user. The hearable device may use the in-ear facing microphone to generate an audio signal representing sound emitted largely through the ear canal when the user speaks, and use the exterior facing microphones to generate respective audio signals representing sound from the exterior environment of the ear of the user.

In some examples, the hearable device may utilize acoustic isolation between the in-ear microphone and the exterior microphones to prevent the microphones from capturing primarily the same sound waves. For instance, the hearable device may include passive acoustic isolation between the microphones (e.g., acoustic blocking material, such as foam, to fill the user's ear canal, headphones which encapsulate the whole user's ear, etc.), and/or active acoustic isolation (e.g., emitting a noise-canceling waveform from a microphone of the hearable device to cancel out noise) to ensure that the in-ear microphone and exterior microphones do not capture primarily the same sound. In this way, the in-ear microphone generates an in-ear audio signal that represents sound transmitted through the ear canal of the user from other portions of the ear, such as the Eustachian tube, the eardrum, bone, tissue, and so forth. Similarly, the exterior microphone may, using acoustic isolation, generate an exterior audio signal that represents sound from the environment exterior the ear of the user. By acoustically isolating the in-ear microphone from the exterior microphones, the in-ear audio signal may represent sounds that were emitted by the user, such as a voice command, cough, clearing of throat, or other user noises. Similarly, the exterior audio signals will represent sounds from the environment exterior the ear of the user, such as wind or other ambient noise, other people speaking, and noises emitted by the user of the hearable device that are loud enough to be detected by the exterior microphones.

Certain implementations and embodiments of the disclosure will now be described more fully below with reference to the accompanying figures, in which various aspects are shown. However, the various aspects may be implemented in many different forms and should not be construed as limited to the implementations set forth herein. The disclosure encompasses variations of the embodiments, as described herein. Like numbers refer to like elements throughout.

FIG. 1 illustrates a schematic diagram of an illustrative environment 100 in which a user 102 wears a hearable device, in this example wireless earbuds 104(1) and 104(2) that include speakers for outputting audio and microphones generating audio signals, such as audio signals representing speech of the user 102. In some instances, one or more of the wireless earbuds 104(1) and/or 104(2) may be configured to generate one or more audio signals representing speech of the user and, potentially, other ambient noise and send the audio signals to a mobile device 106 of the user 102. The mobile device 106 may then send the generated audio signals for output to a user 108 via a mobile device 110 of the user 108. The mobile device 110 may then send the generated audio signals to one or more wireless earbuds 112(1) and 112(2) worn by the user, and/or to other hearable devices associated with the user 108. It is to be appreciated, however, that while the environment 100 described the techniques with reference audio signals sent, over a network 114, for output to another user 108, it is to be appreciated that the described techniques may apply equally to audio signals generated for any other reason. Furthermore, while the techniques below are described with reference to a wireless earbud, it is to be appreciated that the techniques may apply equally to other apparatuses.

As illustrated, in some instances the environment of the user 102 may include wind 116 or other unwanted environmental noise. As such, one or more of the wireless earbuds 104(1) and 104(2) may include components configured to detect the presence of wind in audio signals generated by one or more of the earbuds and, in response, may modify or otherwise generate audio signals to lessen the impact of the wind on these signals. That is, one or both of the wireless earbuds 104(1) and 104(2) may be configured to decrease the presence of the wind 116 in the audio signals sent from the wireless earbuds 104(1) and/or 104(2) to the wireless earbuds 112(1) and 112(2).

As illustrated, the first wireless earbud 104(1) may include one or more network interfaces 118, one or processors 120, one or more microphones 122, one or more loudspeakers 124, and memory 126. The network interfaces 118 may configure the wireless earbud 102(1) to communicate over one or more wired and/or wireless networks to send and receive data with various computing devices, such as the mobile device 106, one or more remote systems, and/or the like. Generally, the network interface(s) 118 enable the wireless earbud 104(1) to communicate over any type of network, such as a wired network (e.g., USB, Auxiliary, cable etc.), as well as wireless networks (e.g., WiFi, Bluetooth, Personal Area Networks, Wide Area Networks, and so forth). In some examples, the network interface(s) 118 may include a wireless unit coupled to an antenna to facilitate wireless connection to a network. However, the network interface(s) may include any type of component (e.g., hardware, software, firmware, etc.) usable by the wireless earbud 104(1) to communicate over any type of wired or wireless network. The network interface(s) 118 may enable the wireless earbud 104(1) to communicate over networks such as a wireless or Wi-Fi network communications interface, an Ethernet communications interface, a cellular network communications interface, a Bluetooth communications interface, etc., for communications over various types of networks, including wide-area network, local-area networks, private networks, public networks etc. In the case of a wireless communications interfaces, such network interface(s) 118 may include radio transceivers and associated control circuits and logic for implementing appropriate communication protocols.

The one or more microphones 122, meanwhile, may be configured to generate audio signals representing speech of the user 102 and/or environmental noise surrounding the user 102, such as the illustrated wind 116. In some instances, the microphones 122 may generate these audio signals in response to a user input, such as in response to a physical input at the wireless earbud 102(1) or at the mobile device 106, a wake word received at the wireless earbud 102(1) or at the mobile device 106, or in response to any other input. In some instances, the microphones 122 include a first, outward-facing microphone, a second, outward-facing microphone, and a third, inward-facing microphone. That is, the first and second microphones may reside outside of the ear canal of the user and may be oriented towards a mouth of the user 102. Thus, the first and second microphones may be exposed to environmental noise, such as the illustrated wind 116. The third, inward-facing microphone, meanwhile, may reside within an ear canal of the user 102 and, thus, may be isolated from environmental noise, such as the wind 116. The one or more loudspeakers 124, meanwhile, may also reside within the ear canal of the user and may be configured to output received audio signals corresponding to any type of audio, such as speech of the user 108, music, audio books, and/or the like.

The one or more processors 120 may include a central processing unit (CPU) for processing data and computer-readable instructions, and the memory 126 may comprise computer-readable storage media storing the computer-readable instructions that are executable on the processor(s) 120. The memory 126 may include volatile random access memory (RAM), non-volatile read only memory (ROM), non-volatile magnetoresistive (MRAM) and/or other types of memory for storing one or more components. As illustrated, the memory 126 may store a coherence-determination component 128, an audio-processing component 130, an output-audio-signal component 132, and an adaptive-equalizer component 134.

The coherence-determination component 128 may be configured to determine one or more levels of coherence (e.g., respective levels of similarity) between two or more audio signals generated by the wireless earbud 104(1) for determining an amount of wind 116 or other unwanted environmental noise present in the one or more audio signals. For example, the coherence-determination component 128 may be configured to determine one or more levels of coherence between a first audio signal generated by the first, outward-facing microphone and a second audio signal generated by the second, outward-facing microphone. These one or more coherence value(s) may be used by the output-audio-signal component 132 for determining how to generate output audio signals that represent a minimal amount of the wind 116, as described below.

The coherence-determination component 128, meanwhile, may be configured to determine the coherence level (s) in any number of ways. In some instances, the coherence-determination component 128 is configured to apply a Fourier transform to each audio signal to be compared to generate a predefined number of frequency bins or ranges. The coherence-determination component 128 may then determine a coherence level between each respective frequency range, which the output-audio-signal component 132 may use to determine how to generate the output audio signals (e.g., for sending to the mobile device 110 for output to the user 108).

In one example, the coherence-determination component 128 may calculate these coherence values for individual frequency bins using the following equation:

$$C_{xy}(f) = \frac{\lceil G_{xy}(f) \rceil^2 + \alpha}{G_{xx}(f) G_{yy}(f) + \alpha} \tag{2}$$

where $G_{xy}(f)$ represents a cross-spectral density between the first audio signal generated by the first outer microphone ("x") and the second audio signal generated by the second outer microphone ("y"), $G_{xx}(f)$ represents auto-spectral density of the first audio signal, $G_{yy}(f)$ represents auto-spectral density of the second audio signal, and a represents a regularization coefficient, which may be calculated for each frequency bin a priori. It is noted that inclusion of the regularization coefficient in equation (1) may result in an individual coherence value, $C_{xy}(f)$, comprise a number between zero (0) and one (1), where zero (0) represents very little coherence between the audio signals, and hence a significant presence of wind, and one (1) represents perfect coherence and, thus, a complete lack of wind.

After calculating an initial coherence value for one or more frequency ranges (or "bins"), the coherence-determination component 128 may proceed to perform one or more smoothing operations on one or more of these values. For example, the coherence-determination component 128 may smooth each calculated initial coherence value based on one or more prior coherence values for the respective frequency range. In some instances, this smoothing over time may lessen the amount of change between coherence values for a frequency range over two contiguous time periods to avoid large changes in these values over short amounts of time. Furthermore, in some instances, the effect of prior coherence value(s) on a current, initial coherence value may be larger when moving from a lower value to a higher value (i.e., from more wind to less wind) than when moving from a higher value to a lower value (i.e., from less wind to more wind). In other instances, the opposite may be true, and in still other instances the effect may be equal.

In addition, the coherence-determination component 128 may smooth an initial coherence value across one or more frequency bins. In some instances, the coherence-determination component 128 may perform this smoothing operation asymmetrically, such that a coherence value of a particular frequency bin may be modified based on coherence value(s) of one or more prior frequency ranges. For example, a frequency bin corresponding to a range of 125 kHz to 187.5 kHz may be smoothed based on a coherence value of one or more prior frequency bins, such as a bin corresponding to a range of 62.5 kHz to 125 kHz and/or a bin corresponding to 0 to 62.5 kHz.

In some instances, the smoothing of these initial coherence values may result in a set of coherence values that the output-audio-signal component 132 may use to determine to process audio signals to alleviate the impact of wind and/or other unwanted environmental noise from the signals. In addition to performing one or more of these smoothing functions to the initial coherence values, the coherence-determination component 128 may calculate a coherence values for a first set of the frequency bins to determine coherence values for a remainder of the frequency bins. For example, given that wind is often present at relatively lower frequencies, the first wireless earbud may calculate coherence values for a set of one or more lower frequency ranges for determining coherence values for relatively higher frequency ranges.

To provide an example, the coherence-determination component 128 may calculate coherence values for the first sixteen (16) frequency ranges (e.g., 0 to 62.5 kHz, 62.5 kHz to 125 kHz, etc.). After calculating these values, the coherence-determination component 128 may determine whether these coherence values meet one or more predefined criteria. If so, then the first wireless earbud may determine that wind is not present in the signal and, thus, may set coherence values for the remaining frequency ranges (e.g., the remaining 112 bins) to a value of one (1) or similar. That is, given that the coherence-determination component 128 has determined that the coherence values of the first sixteen (16) frequency bins is not indicative of a meaningful presence of wind, the coherence-determination component 128 may determine that wind is not present and, thus, may refrain from altering the audio signals based on coherence values at relatively higher frequencies. In some instances, the criteria for making this determination may be based on an average coherence value of the first set of frequency ranges, a median coherence value, whether a threshold number of the first set of coherence values is greater than a threshold value, and/or the like. For example, in some instances coherence-determination component 128 may calculate an average of the coherence values of the first set of frequency ranges (e.g., the first sixteen bins) and may compare this value to a threshold (e.g., 0.7) to determine whether the average is greater than the threshold. If the average is greater than a threshold, then coherence-determination component 128 may set the remaining coherence values to a value of one (1) or similar. If the average is not greater than the threshold, then coherence-determination component 128 may continue to perform one or more of the smoothing operations on the initial coherence values for the remaining frequency ranges for determining final coherence values for these ranges.

After determining the final coherence values for the number of N frequency ranges, the output-audio-signal component 132 may process one or more audio signals based at least in part on these values to lessen the impact of wind and/or other unwanted environmental noise from the resulting signals. For example, the output-audio-signal component 132 may determine, for each wireless earbud, whether to use an audio signal generated by one or more of the outer microphones, an audio signal generated by the respective inner microphone, or a combination thereof. Stated otherwise, the output-audio-signal component 132 may determine an amount of an outer audio signal(s) to use and/or an amount of an inner audio signal to use when generating an output audio signal(s) for sending to a remote device, such as the illustrated mobile device 110 operated by the user 108.

In some instances, the audio-processing component 130 processes one or more of the generated audio signals prior to the output-audio-signal component 132 generating one or more final output audio signals for transmission to the mobile device 110 or other destination. For example, the audio-processing component 130 may perform one more filtering, beamforming, or other techniques on the audio signal generated by the inner microphone and/or the outer microphones of the first wireless earbud 104(1). For example, the audio-processing component 130 may apply one or more beamformer coefficients to the audio signals generated by the outer microphone to focus the signal in a direction toward the mouth of the user 102.

In some instance, the output-audio-signal component 132 determines how to generate output audio signals from the now-processed audio signals generated using the inner and outer microphones based at least in part on the respective coherence values calculated by the coherence-determination component 128. Furthermore, the output-audio-signal component 132 may use a single algorithm for determining how to generate these output audio signals or may use two or more different algorithms. For example, the output-audio-signal component 132 may determine how to generate a first portion of an output audio signal that is less than a predefined frequency using a first algorithm and may determine how to generate a second portion of the output audio signal that is greater than the predefined frequency using a second, different algorithm. For example, the output-audio-signal component 132 may generate a portion of an output audio signal that is less than four (4) kHz by using an algorithm that determines, based on coherence values corresponding to frequency ranges that are less than four kHz, whether to generate an output audio signal using an entirety of the corresponding portion of the inner audio signal, an entirety of one or more of the outer audio signals, or a mixture thereof. Further, for the portion of the output audio signal that is greater than four kHz, the output-audio-signal component 132 may use an algorithm that determines an amount of the outer audio signal(s) to use (if any), while not using any of the inner audio signal.

For example, for frequency bins that are less than four kHz, the output-audio-signal component 132 may determine, for each frequency bin, whether the respective coherence value for that frequency bin is less than a first threshold (e.g., 0.3). If so, meaning that the two outer audio signals generated by the two wireless earbuds have a relatively low coherence to one another, then the output-audio-signal component 132 may effectively detect the presence of wind and, thus, may generate, for that frequency range, a portion of an output audio signal based on the audio signal generated by the inner microphone. That is, because the coherence value for that respective frequency range indicates a strong presence of wind, the output-audio-signal component 132 may be configured to select the audio signal generated by the inner microphone, which is protected from wind, rather than the audio signal generated by the outer microphone, which is not protected from the wind.

If, however, the output-audio-signal component 132 determines that the coherence value for the particular frequency range is not less than the first threshold, then the output-audio-signal component 132 may determine whether the coherence value is greater than a second threshold value (e.g., 0.7) that is greater than the first threshold value. That is, the first wireless earbud may determine whether there is little presence of window in the current frequency range, as evidenced by the relatively strong coherence between the two audio signals generated by the respective microphones for the current frequency range. If the output-audio-signal component 132 determines that the coherence value is greater than the second threshold value, then the output-audio-signal component 132 may generate the portion of the output audio signal corresponding to the current frequency range using the audio signal(s) generated by the outer microphone(s) (given that while this outer microphones are generally exposed to wind, wind did not appear to have an impact at this frequency range).

If, however, the coherence value for the current frequency range is not greater than the second threshold value, but is greater than the first threshold value, then the output-audio-signal component 132 may generate a portion of the output audio signal corresponding to the current frequency range based on both the inner audio signal and one or more both of the outer audio signals. For example, the output-audio-signal component 132 may determine, based on the coherence value, a weight to apply to each of these different audio signals for determining the resulting portion of the output audio signal. In one example, the output-audio-signal component 132 utilizes a linear function from the first threshold (e.g., 0.3) to the second threshold (e.g., 0.7), such that for a frequency range having a coherence value very near the first threshold (e.g. 0.31), the first wireless earbud generates a portion of an audio signal for the frequency range that is largely based on the inner audio signal. Conversely, when a frequency range has a coherence value very near the second threshold (e.g., 0.69), then the output-audio-signal component 132 generates a portion of the audio signal for the frequency range is largely based on one or both of the outer audio signals. Of course, it is to be appreciated that any other function (e.g., step function, decay function, etc.) may be used to determine how to mix the outer and inner audio signals. Furthermore, it is to be appreciated that the output-audio-signal component 132 may use the algorithm discussed immediately above to generate a portion of each output audio signal on a frequency bin-by-bin basis based on each corresponding coherence value.

In addition, for frequency ranges that are over four kHz, the output-audio-signal component 132 may utilize an algorithm that determines how much of an outer audio signal to use (if any at all). For example, for each frequency range between four kHz and eight kHz, the output-audio-signal component 132 may determine whether the respective coherence value is less than a third threshold value (e.g., 0.7). If so (meaning wind is present), then the first wireless earbud may simply refrain from using any data within that particular portion of the audio signal to be output. If not, then the output-audio-signal component 132 may determine whether the coherence value is greater than a fourth, greater threshold (e.g., 0.9). If so (meaning that very little or no wind is present), then the output-audio-signal component 132 may generate the portion of the output audio signal corresponding to the current frequency range using the corresponding portion of one or both of the outer audio signals (and none of the inner audio signal). If, however, the coherence value is greater than the third threshold but less than the fourth threshold, then the output-audio-signal component 132 may generate the corresponding portion of the output audio signal based on an attenuation of a corresponding portion of one or both of the outer audio signals. In some examples, the output-audio-signal component 132 may apply an amount of an attenuation based on a linear function, a step function, a decay function, or the like. In each instance, the amount of the attenuation may be greater when the coherence value is nearer the first threshold (e.g., 0.71) and lesser when the coherence value is nearer the second threshold (e.g., 0.89). Thus, the output-audio-signal component 132 may utilize an algorithm for frequency ranges over 4 kHz (or any other example threshold frequency value) where either no audio signal is used (if there is significant wind), an entirety of a corresponding portion of an outer audio signal is used (if there is little or no wind), or an attenuated version of the corresponding portion of the outer audio signal is used (if there is some wind). In some instances an amount of attenuation of the portion of the first audio signal is inversely proportional to a level of coherence represented by the coherence value, such that a relatively high coherence value results in less attenuation then a lower coherence value.

Upon generating the different portions of an output audio signal (e.g., 256 portions) for the first wireless earbud 104(1), the output-audio-signal component 132 may generate an output audio signal based on the respective generated portions. Further, the second wireless earbud 104(1) may perform similar techniques using its respective first, second, and third microphones for generating a respective output audio signal. It is to be appreciated that by generating the output audio signal(s) in this manner, the wireless earbud(s) may lessen the impact of any wind or other unwanted environmental noise on the quality of audio that is output using the generated output audio signals. That is, by alleviating the impact of wind or other unwanted environmental noise on the resulting output audio signals, the quality of resulting audio may be higher than would result from outputting audio signals that have not been processed based on the presence of wind or unwanted noise.

Given that the output-audio-signal component 132 may generate an output audio signal based on both the audio signal generated by the inner microphone and the audio signal generated by the outer microphone, the adaptive-equalizer component 134 may be configured to equalize the sound of the inner microphone to the sound of the outer microphone(s) while the user 102 speaks (e.g., such that the voice of the user sounds the same in both audio signals). That is, because the sound generated by the voice of the user takes different paths to the outer and inner microphone (e.g., through the air versus through bone/tissue of the user, respectively), the adaptive-equalizer component 134 may adaptively equalize these signals. Furthermore, because of the physiological differences amongst different users, the adaptive-equalizer component 134 may equalize this sound in an adaptive, rather than fixed, manner. In some instances, the adaptive-equalizer component 134 may estimate frequency response differences between the two audio signals when the user 102 is speaking, no wind 116 is present, and/or the external environmental noise is minimal.

In some instances, the adaptive-equalizer component 134 may perform this adaptive equalization using a Kalman filter framework, applied in the sub-band domain on a frequency-bin-by-frequency-bin basis. The state of the Kalman filter may comprise the magnitude difference between the primary signal path and the inner-microphone audio signal (e.g., acting as the filter weights). The measurement equation may comprise the multiplication of the estimated weights and the inner audio signal. The measurement noise variance of the Kalman filter, R, may control the adaptation speed of the filter. A large R may mean, in some instances, that there is a lot of noise in the current measurement, meaning that the filter may not adapt because the current measurements are unreliable. Thus, if the user is speaking, and there is no wind or large environment noise present, then R may set to be a small value, allowing the filter to adapt. When wind noise is present, however, or when the user is not speaking, or if the environment noise is loud, compared to the user's speech, then R may be set to a large value and the adaptation may be frozen.

Thus, as described above, one or both of the wireless earbuds 104(1) and 104(2) may be configured to detect the presence of wind in audio signals generated by the respective earbud or other hearable device and, in response, may modify or otherwise generate audio signals to lessen the impact of the wind on these signals. That is, one or more of the wireless earbuds 104(1) and 104(2) may be configured to decrease the presence of the wind 116 in the audio signals sent from the wireless earbuds 104(1) and/or 104(2) to the wireless earbuds 112(1) and 112(2).

Further, and as introduced above, one or more of the wireless earbuds may include components that enable the earbuds to perform various operations based on the voice commands, such as streaming audio data (e.g., music) and outputting the audio data using an in-ear speaker, performing a telephone call, and so forth. In some examples, the wireless earbud 104(1) may be a sophisticated voice-enabled device that include components for processing the voice commands to determine respective intents of the voice commands of the user 102, and further determining an operation that the wireless earbud 104(1) is to perform based on each respective intent of the voice command of the user 102. However, the wireless earbud 104(1) may, in some examples, have less functionality and may simply perform some types of pre-processing on audio data representing the voice commands of the user 102. For instance, the wireless earbud 104(1) may merely serve as an interface or "middle man" between a remote system, or server, and the user 102. In this way, the more intensive processing used for speech processing may be performed using large amounts of resources of remote services.

Accordingly, the wireless earbud 104(1) may include the 118 network interfaces which configure the wireless earbud 104(1) to communicate over one or more networks to send and receive data with various computing devices, such as one or more remote systems which may include various network-accessible resources. In some examples, the remote system(s) 136 may be a speech processing system (e.g., "cloud-based system," "software as a service (SaaS)," "network-accessible system," etc.) which receives audio data from the wireless earbud 104(1) representing a voice command of the user 102. For instance, the wireless earbud 104(1) may receive a "wake" trigger (e.g., wake word) which indicates to the wireless earbud 104(1) that the user 102 is speaking a voice command, and the wireless earbud 104(1) may begin streaming, via a network interface and over the network(s), audio data representing the voice command as captured by the microphones of the wireless earbud 104(1) to the remote system(s). However, in some examples, the wireless earbud 104(1) may be unable to, or refrain from doing so to conserve power, communicate over certain network(s) (e.g., wide-area networks). In such examples, the wireless earbud 104(1) may be communicatively coupled to a user device, such as the mobile device 106, in the environment 100 of the user 102. The wireless earbud 104(1) may communicate audio data representing the voice command to the user device 106 using the network interfaces and over another network (e.g., Bluetooth, WiFi, etc.). The user device 106 may be configured to, in turn, transmit the audio data representing the voice command to the remote system (s) over the network(s).

Figure 2:
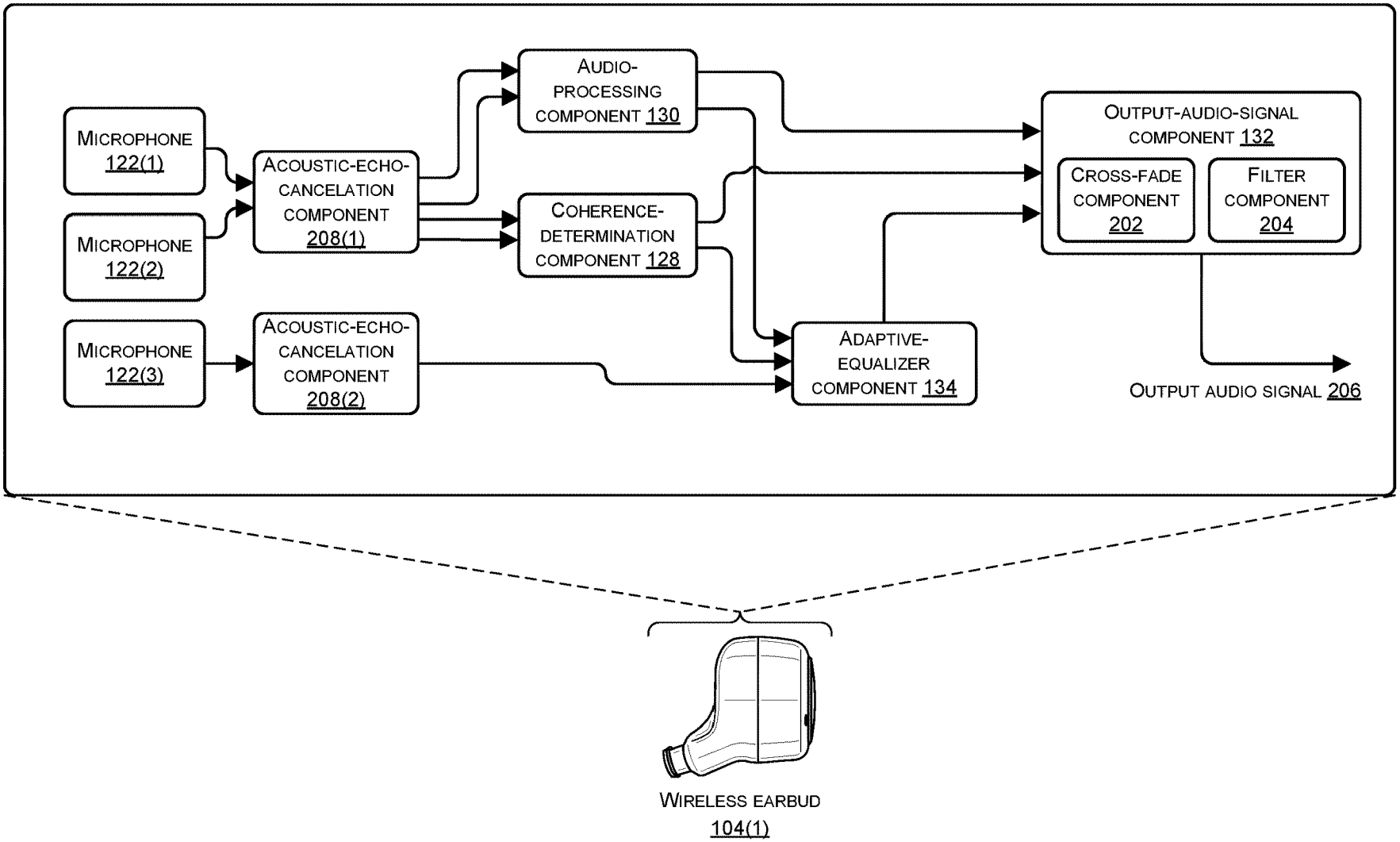
FIG. 2 illustrates an example data flow of example components of a wireless earbud for processing audio signals in a manner lessen the impact of wind and/or other environmental noise on audio signals generated at the wireless earbuds.

FIG. 2 illustrates an example data flow of example components of the first wireless earbud 104(1) for processing audio signals in a manner lessen the impact of wind and/or other environmental noise on audio signals generated at the wireless earbuds 104(1) and/or 104(2). As illustrated, the first wireless earbud 104(1) may include at least a first microphone 122(1), a second microphone 122(2), and a third microphone 122(3). The first microphone 122(1) and the second microphone 122(2) may each comprise an outward-facing microphone that does not reside in the ear of the user when worn and is directed substantially towards a mouth of the user. While the first and second microphones 122(1) and 122(2) may be exposed to wind or other environmental noise, the third microphone 122(3) may comprise an inward-facing (e.g., in-ear) microphone that is generally isolated from these noises.

As illustrated, a first audio signal generated by the first microphone 122(1) and a second audio signal generated by the second microphone 122(2) may be input into an acoustic-echo-cancellation (AEC) component 208(1), which may perform AEC techniques on each of these signals to "clean" the respective signals. Further, the now-cleaned first and second signals may then be provided to the coherence-determination component 128. That is, the coherence-determination component 128 may receive, as input, the respective audio signals generated by the respective outward-facing microphones of the first wireless earbud. As described above, the coherence-determination component 128 may determine one or more levels of coherence between these signals. That is, the coherence-determination component 128 may apply a Fourier transform to each of the audio signals to generate a predefined number of frequency ranges (e.g., 256) and may compare the corresponding frequency ranges to one another to generate a respective coherence level. As described above, a relatively high level of coherence may indicate a lack of wind or other environmental noise, while a relatively low level of coherence may indicate the presence of such noise.

FIG. 2 further illustrates that the audio-processing component 130 may receive, as input, the first audio signal generated by the first microphone 122(1) and the second audio signal generated by the second microphone 122(2). As described above, the audio-processing component 130 may process this audio signals by applying one or more filters to the signal, applying beamformer coefficients to the signal, and/or the like. As illustrated, the output of the audio-processing component 130 and the coherence-determination component 128 may be provided to the output-audio signal component 132, which may determine how to generate output audio signals 206 based, at least in part, on the respective coherence levels at the different frequency ranges. In some instances, the output of the audio-processing component 132 may comprise a single audio signal that is based on one or both of the first audio signal generated by the first microphone 122(1) and the second audio signal generated by the second microphone 122(2). As illustrated, the output-audio-signal component 132 may comprise a cross-fade component 202 and a filter component 204.

The cross-fade component 202 may generate respective portions of output audio signals 206 below a predefined frequency (e.g., four (4) kHz) and may determine, based on respective coherence values at the different frequency ranges, an amount of the audio signal generated by the microphone 122(1), an amount of the audio signal generated by the microphone 122(2), and/or an amount of the audio signal generated by the microphone 122(3) to include in the output audio signal. For example, the cross-fade component 202 may perform some or all of the process shown in FIG. 4A.

The filter component 204, meanwhile, may generate respective portions of output audio signals 206 above the predefined frequency and may determine, based on respective coherence values at different frequency ranges, an amount of the audio signal of the microphone 122(1) and/or the microphone 122(2) to include as part of the output audio signal. For example, and as described above, if a particular coherence value indicates that there is very little wind, then the filter component 204 may refrain from attenuating the audio signal generated by the microphones 122(1) and/or 122(2) and instead may use one or more of these audio signals as the output audio signal. If, however, the coherence value indicates significant wind, then the filter component 204 may refrain from using any portion of the audio signals generated by the outer microphones 122(1) and/or 122(2) (or any other audio signal) as the output audio signal. If the coherence value is between these thresholds, however, then the filter component 204 may attenuate the audio signal generated by the outer microphones 122(1) and/or 122(2) and may use this attenuated signal as the respective portion of the output audio signal. In some instances, the filter component 204 may perform some or all of the process shown in FIG. 4B.

In addition to the above, FIG. 2 further illustrates that both the audio signal generated by the first and second microphones 122(1) and 122(2) and the audio signal generated by the third microphone 122(3) may be provided, as input, to the adaptive-equalization component 134. The adaptive-equalization component 134 may receive the first and second audio signals after they have been cleaned by the AEC component 208(1) and, similarly, the adaptive-equalization component 134 may receive the third audio signal generated by the third microphone 122(3) after the same or a different AEC component 208(2) has cleaned the third audio signal. Furthermore, and as described above, the adaptive-equalization component 134 may function to equalize the sound from the each of these audio signals such that resulting audio associated with the generated audio signals sounds uniform, despite the output audio signal including varying amounts of the audio signals generated by the outer and inner microphones at different frequency ranges.

Figure 3:
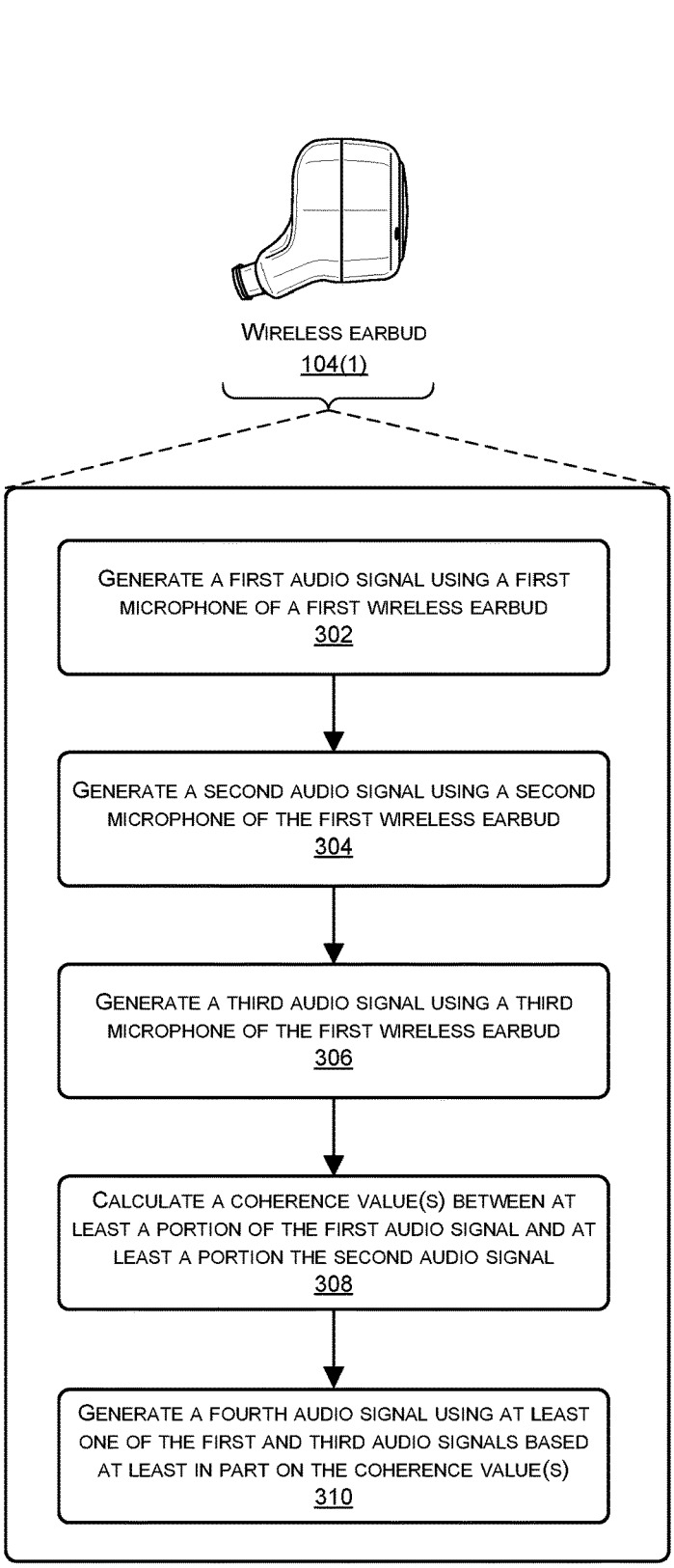
FIG. 3 illustrates a flow diagram of an example process for identifying wind and/or other environmental noise and generating audio signals in a manner to lessen the impact of this unwanted noise.

FIG. 3 illustrates a flow diagram of an example process 300 for identifying wind and/or other environmental noise and generating audio signals in a manner to lessen the impact of this unwanted noise. The example processes described herein are illustrated as logical flow graphs, each operation of which represents a sequence of operations that can be implemented in hardware, software, or a combination thereof. In the context of software, the operations may represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described in the example processes is not intended to be construed as a limitation, and any number of the described operations can be combined in any order and/or in parallel to implement the respective process. Further, while FIG. 3 and other processes described herein illustrated and described as being performed by different components of a wireless earbud, it is to be appreciated that some or all of these processes may instead be performed by a user device, remote servers, and/or the like. Further, while FIG. 3 illustrates the process 300 as being performed by the first wireless earbud 104(1), it is to be appreciated that the second wireless earbud 104(2) may similarly perform the process 300 using inner and outer microphones of the second wireless earbud 104(2).

At an operation 302, a first microphone of a first wireless earbud generates a first audio signal. As described above, the first microphone may comprise an outward-facing microphone and, thus, may be exposed both to user speech and unwanted environmental noise, such as wind. Similarly, at an operation 304, a second microphone of the first wireless earbud may generate a second audio signal. The second microphone may also comprise an outward-facing microphone and, thus, may also be exposed to both the user speech and the unwanted environmental noise. At an operation 306, meanwhile, a third microphone of the first wireless earbud may generate a third audio signal. In some instances, the third microphone of the first wireless earbud may comprise an inward-facing (e.g., in-ear) microphone that is generally isolated from the unwanted environmental noise.

At an operation 308, the first wireless earbud may calculate one or more coherence values between at least a portion of the first audio signal and at least a portion of the second audio signal. In some instances, this operation may include applying a Fourier transform to each of the audio signals to convert each respective signal into the frequency domain. Then, each of multiple frequency ranges of these audio signals may be compared to one another to determine a level of coherence for this particular frequency range. For example, a first frequency range of the first audio signal may be compared with a first frequency range of the third audio signal to generate a first coherence value, a second frequency range of the first audio signal may be compared with a second frequency range of the third audio signal to generate a second coherence value, and so forth. It is noted that while the operation 308 is described as comparing two audio signals generated by respective outer microphones of the same wireless earbud, in other instances this operation may comprise comparing a first audio signal generated by an outer microphone of a first wireless earbud with a second audio signal generated by an outer microphone of a second wireless earbud. In these instances, the second wireless earbud may send the second audio signal to the first wireless earbud to allow the first wireless earbud to calculate coherence values.

At an operation 310, the first wireless earbud may generate a fourth audio signal using at least one of the first and/or third audio signals. For example, the first wireless earbud may determine an amount of the first audio signal and/or an amount of the third audio signal to use in generating the fourth audio signal based at least in part on the one or more coherence values. For instance, the first wireless earbud may determine an amount of the first and/or third audio signal to use in generating the first frequency range of the fourth audio signal based on the first coherence value, an amount of the first and/or third audio signal to use in generating the second frequency range of the fourth audio signal based on the second coherence value, and so forth. Furthermore, in some instances the fourth audio signal may be based on at least a portion of each of the first, second, and third audio signals (e.g., the two outer-microphone audio signals and the inner-microphone audio signal).

Figure 4A:
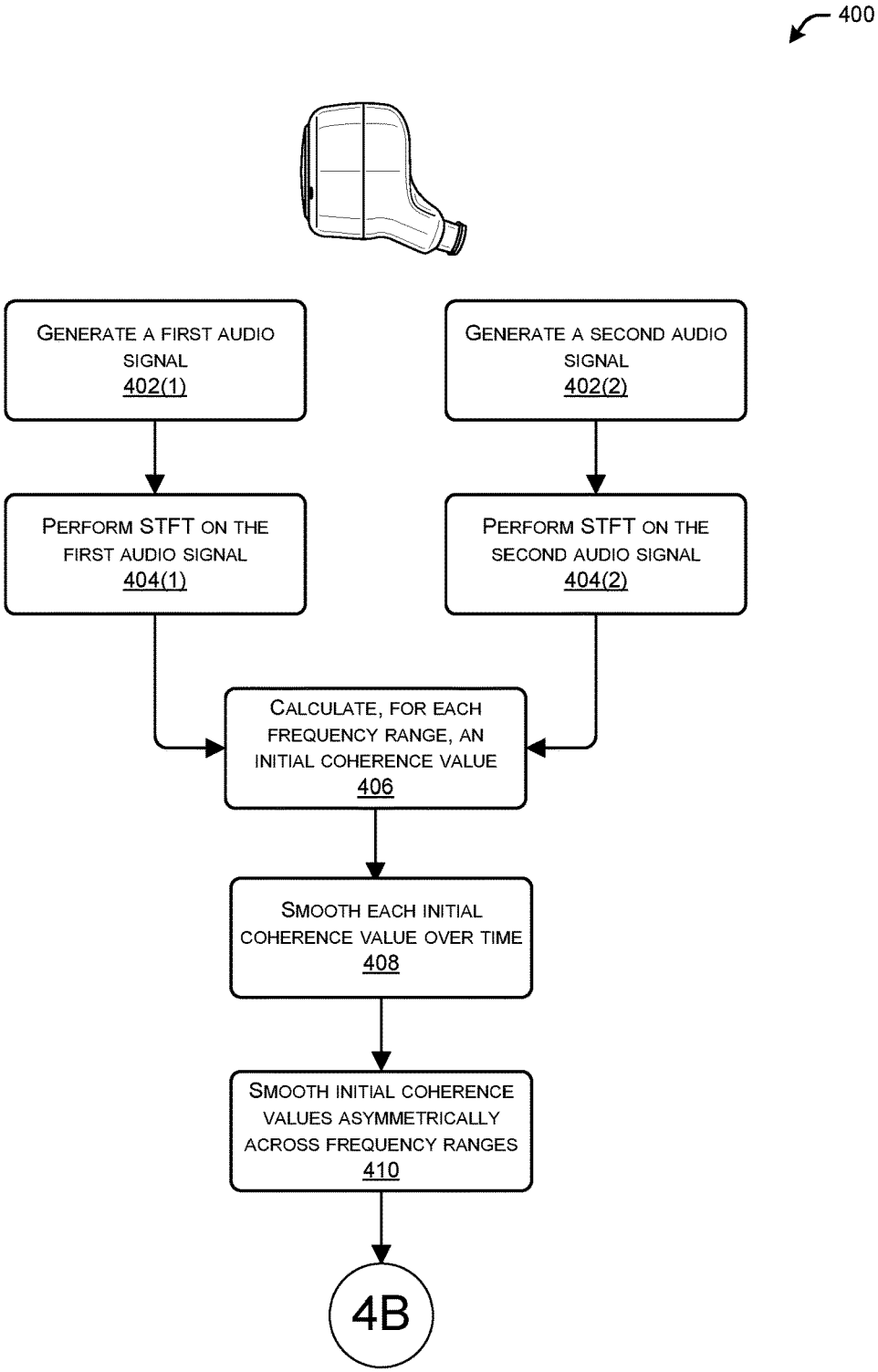
FIGS. 4A-B collectively illustrate a flow diagram of an example process for generating coherence values, which may be used to determine an amount of unwanted noise in occurring in an environment of a user using the wireless headphones of FIG. 1.
Figure 4B:
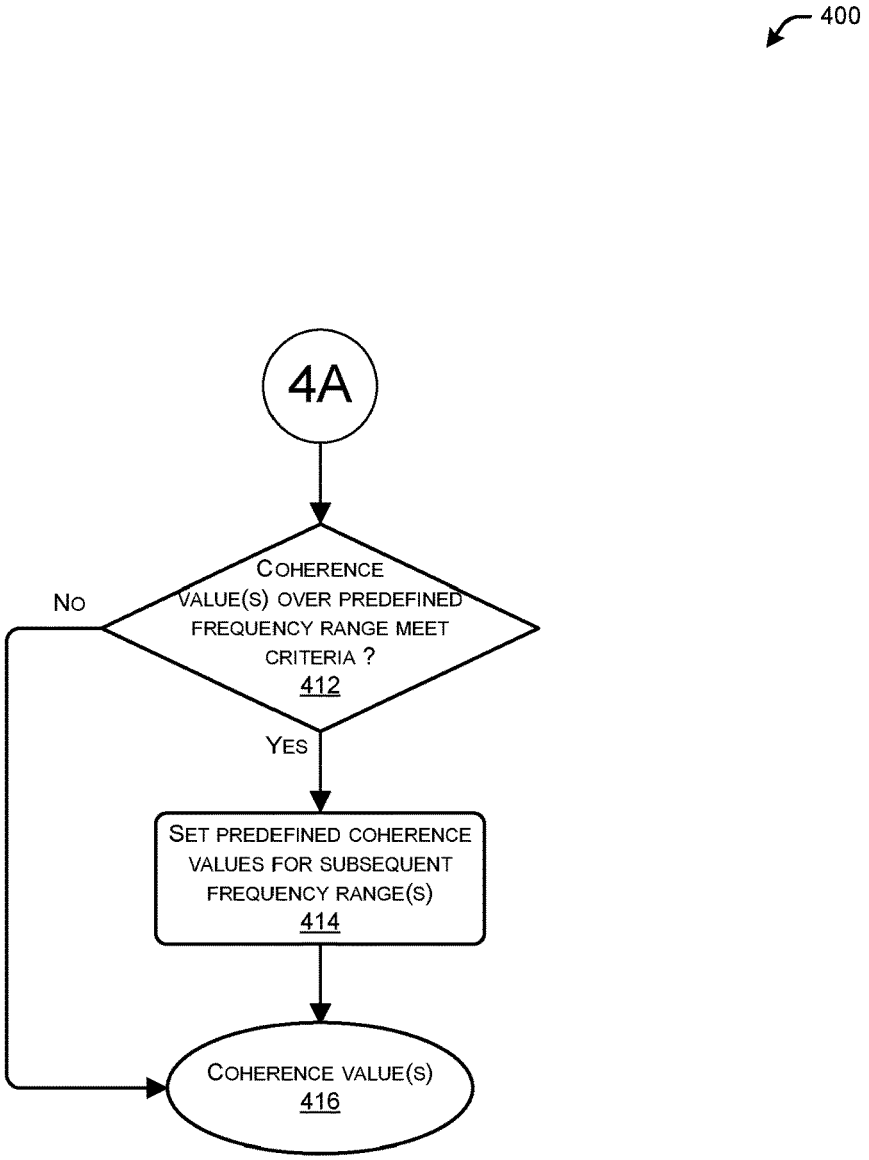

FIGS. 4A-B collectively illustrate a flow diagram of an example process 400 for generating coherence values, which may be used to determine an amount of unwanted noise in occurring in an environment of a user using the wireless headphones of FIG. 1. While FIGS. 4A-B illustrate the process 400 as being performed by the first wireless earbud 104(1), it is to be appreciated that the second wireless earbud 104(2) may similarly perform the process 400 using inner and outer microphones of the second wireless earbud 104 (2).

At an operation 402(1), a first wireless earbud may generate a first audio signal, such as a first audio signal based on a first outward-facing microphone of the first wireless earbud. At an operation 402(2), the first wireless earbud may generate a second audio signal based on an outward-facing microphone of the second wireless earbud.

At an operation 404(1), the first wireless earbud may perform a Fourier Transform (e.g., a Short-time Fourier Transform (STFT), a Fast Fourier Transform (FFT), etc.) on a window of the first audio signal to convert the first audio signal into the frequency domain, resulting in a set of N frequency bins. At an operation 404(2), the first wireless earbud may perform a Fourier Transform (e.g., a Short-time Fourier Transform (STFT), a Fast Fourier Transform (FFT), etc.) on a window of the second audio signal to convert the second audio signal into the frequency domain, resulting in a set of N frequency bins. It is to be appreciated that the number, N, of bins may comprise any number, such as 32, 64, 128, 256, or the like. Further, the overall frequency range represented by these bins may comprise any range, such as zero (0) to 8,000 kHz or any other range, and the bins may be of equal size. For instance, in the example of 128 bins from zero (0) to 8,000 kHz, a first bin may represent a frequency range of zero (0) to 62.5 kHz, a second bin may represent a range of 62.5 kHz to 125 kHz, and so forth.

At an operation 406, the first wireless earbud may calculate, for each of the N frequency ranges, an initial coherence value indicating a degree of similarity between the frequency range of the first audio signal and the corresponding frequency range of the second audio signal. In some instances, the first wireless earbud may calculate these coherence values using the following equation:

$$C_{xy}(f) = \frac{[G_{xy}(f)]^2 + \alpha}{G_{xx}(f)G_{yy}(f) + \alpha} \tag{3}$$

where $G_{xy}(f)$ represents a cross-spectral density between the first audio signal ("x") and the second audio signal ("y"), $G_{xx}(f)$ represents auto-spectral density of the first audio signal, $G_{yy}(f)$ represents auto-spectral density of the second audio signal, and a represents a regularization coefficient, which may be calculated for each frequency bin a priori.

As the reader will appreciate, inclusion of the regularization coefficient in equation (1) may result in an individual coherence value, $C_{xy}(f)$, comprise a number between zero (0) and one (1), where zero (0) represents very little coherence between the audio signals, and hence a significant presence of wind, and one (1) represents perfect coherence and, thus, a complete lack of wind.

At an operation 408, the first wireless earbud may smooth each generated initial coherence value over time. In some instances, this smoothing over time may lessen the amount of change between coherence values for a frequency range over two contiguous time periods to avoid large changes in these values over short amounts of time. Furthermore, in some instances, the effect of prior coherence value(s) on a current, initial coherence value may be larger when moving from a lower value to a higher value (i.e., from more wind to less wind) than when moving from a higher value to a lower value (i.e., from less wind to more wind). In other instances, the opposite may be true, and in still other instances the effect may be equal.

At an operation 410, the first wireless earbud may smooth one or more of the initial frequency ranges asymmetrically across frequency ranges. In some instances, the first wireless earbud may perform this smoothing operation asymmetrically, such that a coherence value of a particular frequency bin may be modified based on coherence value(s) of one or more prior frequency ranges. For example, a frequency bin corresponding to a range of 125 kHz to 187.5 kHz may be smoothed based on a coherence value of one or more prior frequency bins, such as a bin corresponding to a range of 62.5 kHz to 125 kHz and/or a bin corresponding to 0 to 62.5 kHz. In some instances, smoothing initial coherence values in this asymmetrical fashion from lower frequency ranges to higher frequency ranges may help in diffusive conditions.

FIG. 4B continues the illustration of the process 400 and includes, at an operation 412, whether one or more coherence values corresponding to a predefined set of one or more frequency ranges meet one or more criteria. For example, this operation may include determining whether these coherence values meet one or more criteria for setting coherence values for one or more other frequency ranges. For example, given that wind is often present at relatively lower frequencies, the first wireless earbud may calculate coherence values for a set of one or more lower frequency ranges for determining coherence values for relatively higher frequency ranges. To provide an example, the first wireless earbud may calculate coherence values for the first sixteen (16) frequency ranges (e.g., 0 to 62.5 kHz, 62.5 kHz to 125 kHz, etc.). After calculating these values, the first wireless earbud may determine whether these coherence values meet one or more predefined criteria. If so, then the first wireless earbud may determine that wind is not present in the signal and, thus, may set coherence values for the remaining frequency ranges (e.g., the remaining 112 bins) to a value of one (1) or similar. That is, given that the first wireless earbud has determined that the coherence values of the first sixteen (16) frequency bins is not indicative of a meaningful presence of wind, the first wireless earbud may determine that wind is not present and, thus, may refrain from altering the audio signals based on coherence values at relatively higher frequencies. In some instances, the criteria for making this determination may be based on an average coherence value of the first set of frequency ranges, a median coherence value, whether a threshold number of the first set of coherence values is greater than a threshold value, and/or the like. For example, in some instances the first wireless earbud may calculate an average of the coherence values of the first set of frequency ranges (e.g., the first sixteen bins) and may compare this value to a threshold (e.g., 0.7) to determine whether the average is greater than the threshold. If the average is greater than a threshold, then the first wireless earbud may set the remaining coherence values to a value of one (1) or similar. If the average is not greater than the threshold, then the first wireless earbud may continue to perform one or more of the smoothing operations on the initial coherence values for the remaining frequency ranges for determining final coherence values for these ranges.

Within the process 400, if the first wireless earbud determines that the one or more criteria have been met, then at an operation 414 the first wireless earbud may set predefined coherence values for subsequent frequency ranges. For example, and as described immediately above, the first wireless earbud may set a coherence value of one (1) for each frequency range above the first sixteen (16) frequency ranges. If, however, the criteria are not met, then the process 400 proceeds to continuing the smoothing functions for each frequency range. In either instance, the process 400 may output a set of final coherence values 416, which may comprise a coherence value for each frequency range.

Figure 5A:
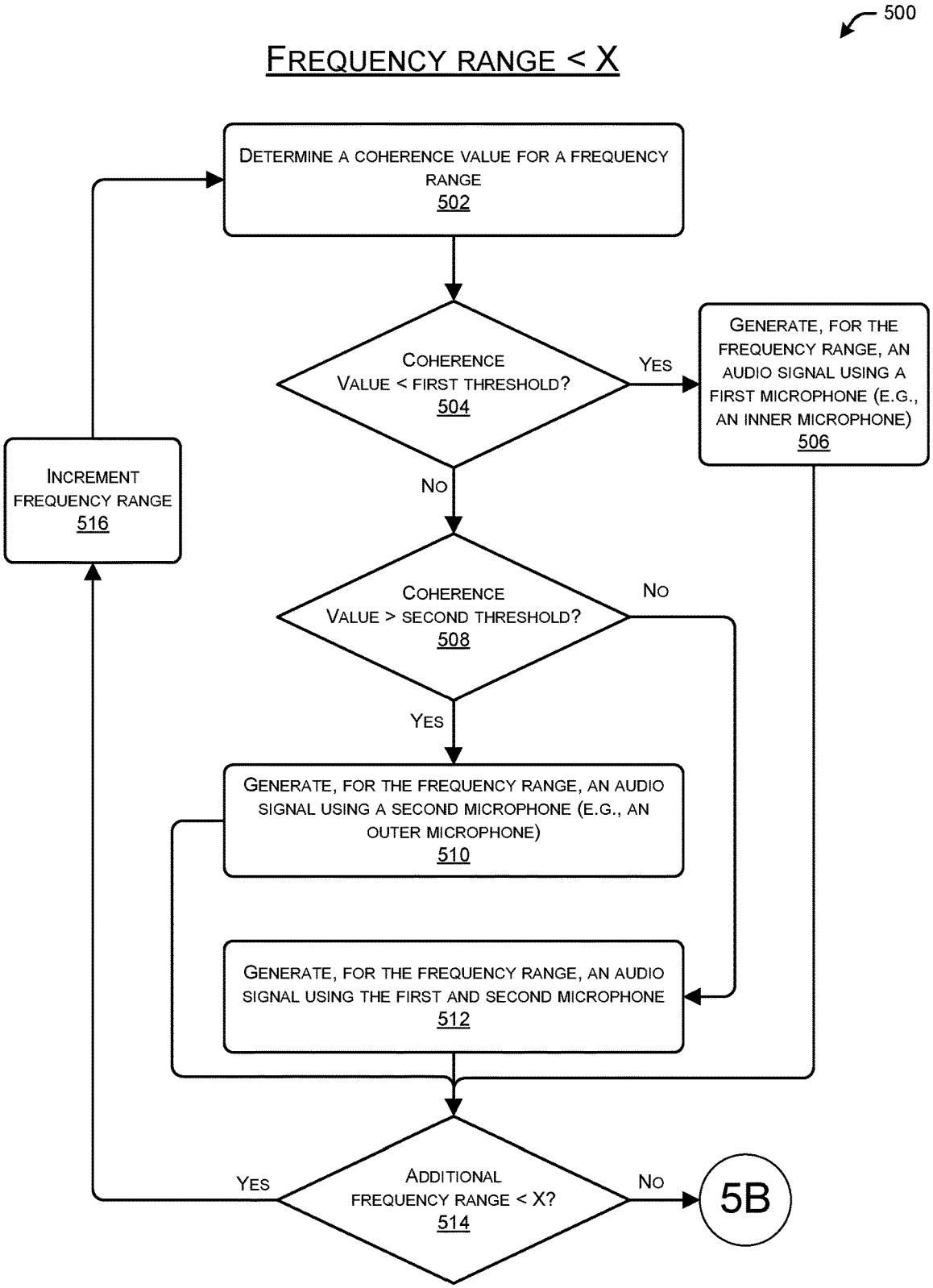
FIGS. 5A-B collectively illustrates a flow diagram of an example process for using the generated coherence values for alleviating the effect of wind and/or other unwanted noise that would otherwise be present in audio signals generated by the wireless earbuds.
Figure 5B:
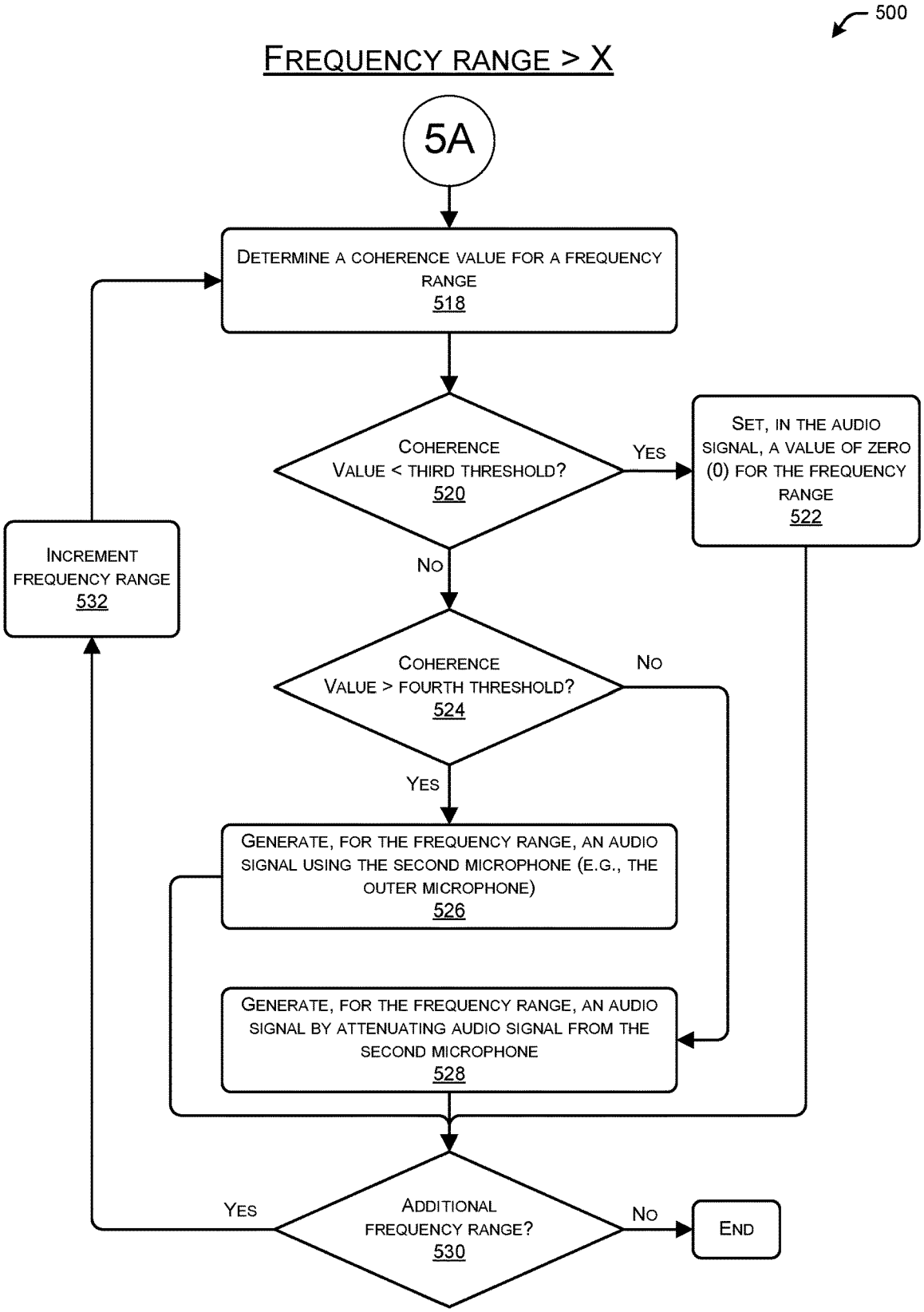

FIGS. 5A-B collectively illustrates a flow diagram of an example process 500 for using the generated coherence values for alleviating the effect of wind and/or other unwanted noise that would otherwise be present in audio signals generated by the wireless earbuds. In some instances, the process 500 may operate using the final coherence values 418 generated using the process 400. Further, in some instances a first portion of the process 500 (e.g., corresponding to FIG. 5A) may be performed for frequency ranges less than a predefined frequency, while a second portion of the process (e.g., corresponding to FIG. 5B) may be performed for frequency ranges above the predefined frequency.

At an operation 502, the first wireless earbud may determine a coherence value for a particular frequency range, such as a first coherence value for a first frequency range (e.g., 0 kHz to 62.5 kHz). At an operation 504, the first wireless earbud determines whether the coherence value is less than a first threshold (e.g., 0.3). If so, meaning that the first and second audio signals a relatively low coherence to one another at the particular frequency range, then the first wireless earbud may effectively detect the presence of wind may proceed to an operation 506. At an operation 506, the first wireless earbud may generate, for that frequency range, a portion of an output audio signal based on the audio signal generated by a first microphone, which may comprise an inward-facing (e.g., in-ear) microphone. That is, because the coherence value for that respective frequency range indicates a strong presence of wind, the first wireless earbud may be configured to select the audio signal generated by an inner microphone, which is protected from wind, rather than the audio signal generated by a second, outward-facing microphone, which is not protected from the wind.

If, however, the coherence value is not less than the first threshold, then at an operation 508 the first wireless earbud may determine whether the coherence value is greater than a second threshold (e.g., 0.7) that is greater than the first threshold value. That is, the first wireless earbud may determine whether there is little presence of window in the current frequency range, as evidenced by the relatively strong coherence between the two audio signals generated by the respective outer microphones for the current frequency range. If the first wireless earbud determines that the coherence value is greater than the second threshold value, then at an operation 510 the first wireless earbud may generate the portion of the output audio signal corresponding to the current frequency range using the audio signal generated by the second (e.g., outward-facing) microphone. In some instances, multiple audio signals generated by respective outward-facing microphones may be used to generate the output audio signal.

If, however, the coherence value is neither less than the first threshold value nor greater than the second threshold value, then at an operation 512 the first wireless earbud may generate the portion of the output audio signal for the frequency range using a portion of the audio signal generated by the first, inner microphone and a portion of the audio signal generated by the second, outer microphone (or a portion of each of multiple audio signals generated by respective outward-facing microphones). For example, the first wireless earbud may determine, based on the coherence value, a weight to apply to each of these different audio signals for determining the resulting portion of the output audio signal. In one example, the first wireless earbud may utilize a linear function from the first threshold (e.g., 0.3) to the second threshold (e.g., 0.7), such that for a frequency range having a value very near the first threshold (e.g. 0.31), the first wireless earbud generates a portion of an audio signal for the frequency range that is largely based on the inner audio signal. Conversely, when a frequency range has a coherence value very near the second threshold (e.g., 0.69), then the first wireless earbud generates a portion of the audio signal for the frequency range is largely based on the outer audio signal. Of course, it is to be appreciated that any other function (e.g., step function, decay function, etc.) may be used to determine how to mix the outer and inner audio signals. Furthermore, it is to be appreciated that the first wireless earbud may use the algorithm discussed immediately above to generate a portion of each output audio signal on a frequency bin-by-bin basis based on each corresponding coherence value.

After generating the portion of the output audio signal corresponding to the current frequency range (e.g., the first frequency range) at one of the operations 506, 508, or 512, the process 500 proceeds to an operation 514. Here, the first wireless earbud determines whether there is an additional frequency range to be analyzed that is less than the predefined frequency. If so, then the operation process to increment the frequency range at an operation 516 before proceeding back to the operation 502. For example, the process 500 may now analyze the coherence value associated with a second frequency range of 62.5 kHz to 125 kHz, and so forth. If, however, there are no remaining frequency ranges to analyze, then the process may proceed to FIG. 5B.

At an operation 518, the first wireless earbud may determine a coherence value for a particular frequency range, such as a coherence value for a first frequency range that is greater than the predefined frequency. At an operation 520, the first wireless earbud determines whether the coherence value is less than a third threshold (e.g., 0.7). If so, meaning that some wind has been detected at this frequency range, then at an operation 522 the first wireless earbud may set a value of zero (0) for this frequency range in the output audio signal. That is, given that this frequency range is relatively high (being above the predefined frequency), such that any user speech will not be well represented in the audio signal generated by the second, inner microphone, and given that the wind will have effect on the audio signal generated by the first, outer microphone, the first wireless earbud may refrain from including any portion of the signals in this frequency range for the output audio signal.

If, however, the first wireless earbud determines that the coherence value is not less than the third threshold, then at an operation 524 the first wireless earbud may determine whether the coherence value is greater than a fourth threshold value (e.g., 0.9) that is greater than the third threshold value. If so, meaning that very little wind has been detected, then the first wireless earbud may generate, at an operation 526, a portion of the output audio signal for the given frequency range using the corresponding portion of the audio signal generated by the second, outer microphone (or a portion of each of multiple audio signals generated by respective outward-facing microphones). That is, given that this audio signal is not likely to be effected by wind to a meaningful degree at this frequency range, the first wireless earbud may use this audio signal generated by the outer microphone as the output audio signal (for this frequency range).

If, however, the coherence value is neither less than the third threshold value nor greater than the fourth threshold value, then at an operation 528 the first wireless earbud may generate, for the frequency range, a portion of the output audio signal by attenuating a corresponding portion of the audio signal generated by the second, outer microphone. That is, given that some wind has been detected at this frequency range, the operation 528 may attenuate the audio signal generated by the second, outer microphone and use this attenuated signal as the output audio signal (for the given frequency range).

After generating the portion of the output audio signal corresponding to the current frequency range at one of the operations 522, 526, or 528, the process 500 proceeds to an operation 530. Here, the first wireless earbud determines whether there is an additional frequency range to be analyzed that is greater than the predefined frequency. If so, then the operation process to increment the frequency range at an operation 532 before proceeding back to the operation 518. If not, then the process 500 may end.

In some implementations, the processors(s) described herein may include a central processing unit (CPU), a graphics processing unit (GPU), both CPU and GPU, a microprocessor, a digital signal processor and/or other processing units or components known in the art. Alternatively, or in addition, the functionally described herein can be performed, at least in part, by one or more hardware logic components. For example, and without limitation, illustrative types of hardware logic components that can be used include field-programmable gate arrays (FPGAs), application-specific integrated circuits (ASICs), application-specific standard products (ASSPs), system-on-a-chip systems (SOCs), complex programmable logic devices (CPLDs), etc. Additionally, each of the processors(s) 140 and 300 may possess its own local memory, which also may store program modules, program data, and/or one or more operating systems. The processors(s) may be located in a single device or system, or across disparate devices or systems, which may be owned or operated by various entities.

The memory (computer-readable media) described herein, meanwhile, may include volatile and nonvolatile memory, removable and non-removable media implemented in any method or technology for storage of information, such as computer-readable instructions, data structures, program modules, or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems, or any other medium which can be used to store the desired information and which can be accessed by a computing device. The computer-readable media may be implemented as computer-readable storage media ("CRSM"), which may be any available physical media accessible by the processor(s) 128 and/or 300 to execute instructions stored on the memory. In one basic implementation, CRSM may include random access memory ("RAM") and Flash memory. In other implementations, CRSM may include, but is not limited to, read-only memory ("ROM"), electrically erasable programmable read-only memory ("EEPROM"), or any other tangible medium which can be used to store the desired information and which can be accessed by the processors(s).

While the foregoing invention is described with respect to the specific examples, it is to be understood that the scope of the invention is not limited to these specific examples. Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Although the application describes embodiments having specific structural features and/or methodological acts, it is to be understood that the claims are not necessarily limited to the specific features or acts described. Rather, the specific features and acts are merely illustrative some embodiments that fall within the scope of the claims of the application.

What is claimed is:

1. A method implemented at least in part by a wireless earbud, the method comprising:

generating a first audio signal by a first microphone of the wireless earbud, the first microphone positioned to capture first sound from an environment in which the wireless earbud is located;

generating a second audio signal by a second microphone of the wireless earbud, the second microphone positioned to capture second sound from the environment;

generating a third audio signal by a third microphone of the wireless earbud, the third microphone positioned to capture second sound from an ear canal of a user;

calculating, for a first frequency range, a first coherence value indicating a level of similarity between the first audio signal and the second audio signal;

determining that the first coherence value is less than a first threshold value, the first threshold value indicative of presence of relatively little wind in the environment;

determining that the first coherence value is greater than a second threshold value that is less than the first threshold value, the second threshold value indicative of presence of significant wind in the environment; and generating, based at least in part on the determining that the first coherence value is less than the first threshold value and the determining that the first coherence value is greater than the second threshold value, a first portion of a fourth audio signal based at least in part on the first audio signal and the third audio signal, the first portion corresponding to the first frequency range.

2. A method as recited in claim 1, further comprising:

calculating, for a second frequency range, a second coherence value indicating a level of similarity between the first audio signal and the second audio signal;

determining that the second coherence value is greater than the first threshold value; and generating a second portion of the fourth audio signal based at least in part on the first audio signal and not the third audio signal, the second portion corresponding to the second frequency range.

3. A method as recited in claim 1, further comprising:

calculating, for a second frequency range, a second coherence value indicating a level of similarity between the first audio signal and the second audio signal;

determining that the second coherence value is less than the second threshold value; and generating a second portion of the fourth audio signal based at least in part on the third audio signal and not the first audio signal, the second portion corresponding to the second frequency range.

4. A method as recited in claim 1, further comprising:

calculating, for a second frequency range that is greater than a threshold frequency value, a second coherence value indicating a level of similarity between the first audio signal and the second audio signal;

determining that the second coherence value is less than a third threshold value, the third threshold value indicative of presence of relatively little wind in the environment;

determining that the second coherence value is greater than a fourth threshold value, the fourth threshold value indicative of presence of significant wind in the environment; and generating a second portion of the fourth audio signal by attenuating a portion of the first audio signal corresponding to the second frequency range.

5. A wireless earbud comprising:

one or more network interfaces;

a first microphone configured to generate a first audio signal;

a second microphone configured to generate a second audio signal;

a third microphone configured to generate a third audio signal;

one or more processors; and one or more computer-readable media storing computer-executable instructions that, when executed, cause the one or more processors to perform acts comprising:

calculating a coherence value indicating a level of similarity between at least a portion of the first audio signal and at least a portion of the second audio signal;

determining that the coherence value is less than a first threshold value representing a first level of coherence;

determining that the coherence value is greater than a second threshold value representing a second level of coherence that is less than the first level of coherence; and generating, based at least in part on the coherence value being less than the first threshold value and greater than the second threshold value, at least a portion of a fourth audio signal based at least in part on the first audio signal and the third audio signal.

6. The wireless earbud of claim 5, wherein:

the first microphone is positioned to capture first sound from an environment of the wireless earbud;

the second microphone is positioned to capture second sound from the environment; and the third microphone is positioned to capture third sound from an ear canal of a user.

7. The wireless earbud of claim 5, the computer-readable media further storing computer-executable instructions that, when executed, cause the one or more processors to perform acts comprising:

calculating an additional coherence value indicating a level of similarity between at least a portion of the first audio signal and at least a portion of the second audio signal;

determining that the additional coherence value is less than the second threshold value; and generating at least an additional portion of the fourth audio signal using the third audio signal and without using the first audio signal.

8. The wireless earbud of claim 5, the computer-readable media further storing computer-executable instructions that, when executed, cause the one or more processors to perform acts comprising:

calculating an additional coherence value indicating a level of similarity between at least a portion of the first audio signal and at least a portion of the second audio signal;

determining that the additional coherence value is greater than the first threshold value; and generating at least an additional portion of the fourth audio signal using the first audio signal and without using the third audio signal.

9. The wireless earbud of claim 5, wherein:

calculating the coherence value comprises calculating a first coherence value for a first frequency range;

generating the at least a portion of fourth audio signal comprises generating a first portion of the fourth audio signal corresponding to the first frequency range based at least in part on the first coherence value;

the computer-readable media further stores computer-executable instructions that, when executed, cause the one or more processors to perform an act comprising:

calculating a second coherence value for a second frequency range, the second coherence value indicating a level of similarity between the first audio signal and the second audio signal in the second frequency range; and generating a second portion of the fourth audio signal corresponding to the second frequency range based at least in part on the second coherence value.

10. The wireless earbud of claim 5, the computer-readable media further storing computer-executable instructions that, when executed, cause the one or more processors to perform acts comprising:

calculating an additional coherence value indicating a level of similarity between at least a portion of the first audio signal and at least a portion of the second audio signal;

generating at least an additional portion of the fourth audio signal by attenuating at least a portion of the first audio signal by an amount that is based at least in part on the additional coherence value, wherein an amount of attenuation is inversely proportional to a level of coherence represented by the additional coherence value.

11. The wireless earbud of claim 5, wherein calculating the coherence value comprises:

calculating an initial coherence value for a first frequency range indicating a level of similarity between the first audio signal and the second audio signal in the first frequency range;

determining a prior coherence value for a second frequency range indicating a level of similarity between the first audio signal and the second audio signal in the second frequency range, the second frequency range being less than the first frequency range; and modifying the initial coherence value for the first frequency range based at least in part on the prior coherence value for the second frequency range.

12. The wireless earbud of claim 5, wherein the calculating the coherence value comprises:

calculating an initial coherence value for a first frequency range indicating a level of similarity between the first audio signal and the second audio signal in the first frequency range for a first time period;

determining a prior coherence value for the first frequency range indicating a level of similarity between the first audio signal and the second audio signal in the first frequency range for a second time period that is prior to the first time period; and modifying the initial coherence value for the first time period based at least in part on the prior coherence value for the second time period.

13. A method comprising:

generating a first audio signal using a first microphone of a wireless earbud;

generating a second audio signal using a second microphone of the wireless earbud;

generating a third audio signal using a third microphone of the wireless earbud;

calculating a coherence value indicating a level of similarity between at least a portion of the first audio signal and at least a portion of the second audio signal;

determining that the coherence value is less than a threshold value; and generating at least a portion of a fourth audio signal using the third audio signal and without using the first audio signal based at least in part on the coherence value.

14. The method of claim 13, wherein:

the first microphone is positioned to capture first sound from an environment of a user wearing the wireless earbud;

the second microphone is positioned to capture second sound from the environment; and the third microphone is positioned to capture third sound from an ear canal of the user.

15. The method of claim 13, wherein:

the calculating the coherence value comprises calculating a first coherence value for a first frequency range;

the generating at least a portion of fourth audio signal comprises generating a first portion of the fourth audio signal corresponding to the first frequency range based at least in part on the first coherence value;

the method further comprises calculating a second coherence value for a second frequency range, the second coherence value indicating a level of similarity between the first audio signal and the second audio signal in the second frequency range; and the generating at least a portion of fourth audio signal comprises generating a second portion of the fourth audio signal corresponding to the second frequency range based at least in part on the second coherence value.

16. A method comprising:

generating a first audio signal using a first microphone of a wireless earbud;

generating a second audio signal using a second microphone of the wireless earbud;

generating a third audio signal using a third microphone of the wireless earbud;

calculating a coherence value indicating a level of similarity between at least a portion of the first audio signal and at least a portion of the second audio signal;

determining that the coherence value is greater than a threshold value; and generating, based at least in part on the coherence value, at least a portion of a fourth audio signal using the first audio signal and without using the third audio signal.

17. A method comprising:

generating a first audio signal using a first microphone of a wireless earbud;

generating a second audio signal using a second microphone of the wireless earbud;

generating a third audio signal using a third microphone of the wireless earbud;

calculating a first coherence value for a first frequency range, the first coherence value indicating a level of similarity between the first audio signal and the second audio signal in the first frequency range;

generating, based at least in part on the first coherence value, a first portion of a fourth audio signal using at least one of the first audio signal or the third audio signal;

calculating a second coherence value for a second frequency range, the second coherence value indicating a level of similarity between the first audio signal and the second audio signal in the second frequency range; and generating, based at least in part on the second coherence value, a second portion of the fourth audio signal using at least one of the first audio signal or the third audio signal.

18. A method comprising:

generating a first audio signal using a first microphone of a wireless earbud;

generating a second audio signal using a second microphone of the wireless earbud;

generating a third audio signal using a third microphone of the wireless earbud;

calculating a coherence value indicating a level of similarity between at least a portion of the first audio signal and at least a portion of the second audio signal; and generating, based at least in part on the coherence value, at least a portion of a fourth audio signal by attenuating a least a portion of the first audio signal in an amount that is based at least in part on the coherence value.

* * * * *